United States Patent [19]

Koseki et al.

[11] 4,101,309

[45] Jul. 18, 1978

[54] METHOD FOR PREPARING TUNGSTEN MATERIALS

[75] Inventors: Isamu Koseki, Yokohama; Motoo Seimiya, Yokosuka, both of Japan

[73] Assignee: Tokyo Shibaura Electric Co., Ltd., Kawasaki, Japan

[21] Appl. No.: 732,073

[22] Filed: Oct. 13, 1976

[51] Int. Cl.[2] ..... B22F 1/00; C22B 34/36

[52] U.S. Cl. ..... 75/0.5 AB; 75/0.5 BB; 134/3; 134/41

[58] Field of Search ..... 75/0.5 A, 0.5 AA, 0.5 AB, 75/0.5 B, 0.5 BA, 0.5 BB, 176; 134/2, 3, 41

[56] References Cited

U.S. PATENT DOCUMENTS

| | | | |
|---|---|---|---|
| 1,859,734 | 5/1932 | George | 134/41 |
| 2,829,962 | 4/1958 | Supiro | 75/0.5 BB |
| 3,136,039 | 6/1964 | Keith | 75/176 |
| 3,661,536 | 5/1972 | Shimizu et al. | 75/176 |
| 3,773,493 | 11/1973 | Brecher et al. | 75/0.5 BB |

FOREIGN PATENT DOCUMENTS

| | | | |
|---|---|---|---|
| 4,540,459 | 12/1970 | Japan | 134/2 |
| 157,918 | 2/1957 | Sweden | 75/0.5 AA |

OTHER PUBLICATIONS

Yamamoto, H.; *Journal of the Japan Society of Powder and Powder Metallurgy*, vol. 19, No. 3, pp. 99–105 (1972) & translation.

*Primary Examiner*—L. Dewayne Rutledge
*Assistant Examiner*—Michael L. Lewis
*Attorney, Agent, or Firm*—Cushman, Darby & Cushman

[57] ABSTRACT

A method for preparing tungsten materials in which tungsten powder obtained by reducing tungsten oxides having doping agents added thereto is washed first with hydrochloric acid having a concentration of not lower than 4% by weight and then with hydrofluoric acid having a concentration of not lower than 3% by weight, and thereafter dried. The above-mentioned washing steps may be carried out at a time by using a mixture of such hydrochloric acid and hydrofluoric acid as specified above. Articles formed by treating tungsten materials obtained by the above-mentioned process are subjected to only a low high temperature deformation.

5 Claims, No Drawings

METHOD FOR PREPARING TUNGSTEN MATERIALS

BACKGROND OF THE INVENTION

This invention relates to an improved method for preparing tungsten materials and, more particularly, to an improvement on the step of washing tungsten powder with an acid.

Tungsten, which is a resistance metal having a high melting point (about 3400° C), is being used in such applications as filaments for common electric tubes and bulbs, heaters for vacuum deposition, and heater elements for cathode ray tubes. The tungsten materials used for the manufacture of such structural parts are required to have good resistance to high temperature deformation.

It is well known that tungsten materials can be prepared by reducing tungsten oxides, such as $WO_3$, $W_4O_{11}$, etc., having added thereto doping agents such as $Al_2O_3$, $K_2O$, $SiO_2$, Fe, Co, and Sn, washing the resulting tungsten powder with an acid such as hydrofluoric acid, hydrochloric acid or nitric acid, and thereafter drying it. Among the foregoing doping agents, $Al_2O_3$, $K_2O$, and $SiO_2$ are used for the purpose of decreasing high temperature deformation, while Fe, Co, and Sn are used for the purpose of improving workability. The use of these doping agents is disclosed in U.S. Pat. No. 3,661,536 filed Sept. 10, 1969 in the name of Tokyo Shibaura Electric Co., Ltd. Kawasaki-shi, Japan. When used as doping agents, $Al_2O_3$, $K_2O$, and $SiO_2$ have the effects of preventing the recrystallization of tungsten from increasing at high temperatures, regulating the particle size of the tungsten powder, and removing undesirable impurities, thereby decreasing high temperature deformation. In addition, the step of washing tungsten powder with an acid serves to wash away unnecessary doping agents and other undesirable impurities and to prevent the recrystallization of tungsten from increasing at high temperatures, thereby again decreasing high temperature deformation.

It has been found that hydrofluoric acid having a concentration of from 3 to 4% by weight can preferably be used in the above-mentioned washing step.

However, if the prior art process including the step of washing tungsten powder with hydrofluoric acid having a concentration of from 3 to 4% by weight is employed to prepare tungsten materials, structural parts obtained by pressing, sintering, and swagging the tungsten materials according to conventional procedure still undergo a high degree of high temperature deformation and show great variation in the amount of deformation among the parts.

SUMMARY OF THE INVENTION

It is a principal object of this invention to provide a method for preparing tungsten materials which can give such structural parts as will undergo only a low degree of high temperature deformation and show little variation in the amount of deformation among the parts.

According to the present invention, there is provided a method for preparing a tungsten material comprising the steps of reducing tungsten oxides having doping agents added thereto, washing the resulting tungsten powder with an acid, and thereafter drying the washed tungsten powder, the improvement being that said washing step comprises washing said tungsten powder first with hydrochloric acid having a concentration of not lower than 4% by weight and preferably from 4 to 12% by weight and then with hydrofluoric acid having a concentration of not lower than 3% by weight and preferably from 3 to 15% by weight.

The above-mentioned washing step may comprise washing said tungsten powder with a mixture of hydrochloric acid having the concentration specified above and hydrofluoric acid having the concentration specified above.

DETAILED DESCRIPTION OF THE PREFERRED EMBODIMENTS

The present invention will be more clearly understood from the example which follows.

EXAMPLE

Tungsten trioxide powder prepared by a conventional method was mixed with a doping solution and then dried until the whole quantity of water was removed. The doping solution, which was mixed with 70 kg of tungsten trioxide powder, consisted of 200 cc of an aluminum chloride solution (aluminum chloride 107 g/l), 1460 cc of a potassium silicate solution (potassium silicate 323 g/l), and 2000 cc of a potassium chloride solution (potassium chloride 100 g/l). The resulting tungsten trioxide powder contained 0.03% by weight of $Al_2O_3$, 0.4% by weight of $SiO_2$, and 0.55% by weight of $K_2O$ as doping agents. This tungsten trioxide powder was, for example, placed in a nickel boat and reduced in a dry hydrogen furnace at a temperature of from 550° to 850° C (under normal pressures) until tungsten powder containing the doping agents and having a predetermined particle, size and size distribution was obtained.

The resulting tungsten powder having uniform properties was divided into portions and washed according to either of the prior art process or the present process. In this case, the washing step was carried out, for example, by placing an adequate volume of dilute hydrofluoric acid having a predetermined concentration, dilute hydrochloric acid having a predetermined concentration, or a mixture thereof in a polyethylene container with a capacity of about 20l, introducing therein about 5 kg of the tungsten powder, and agitating the contents for a period of time ranging from 30 to 90 minutes. After washing, the tungsten powder was dried, for example, in vacuum to obtain a desired sample.

The samples of tungsten powder thus obtained were chemically analyzed and further observed at a magnification of the order of 10,000× with a scanning electron microscope (hereinafter referred to as "SEM"). The results are given in Table 1 below.

In Table 1, the washing time was 60 minutes for Samples 1 through 13, and 30 minutes in HCl and 30 minutes in HF for Samples 14 through 22. Although the data given for Samples 14 through 22 were obtained by washing successively with HCl and HF, the results were substantially the same when the samples were washed for 60 minutes with a mixture of HCl and HF having the indicated concentrations. However, impurities were removed more completely when the samples were washed successively with HCl and HF.

In case of observation with SEM, the samples in which residual doping agents were extensively existing in spongy form were rated as C, the samples in which residual doping agents were locally existing in spongy form rated as B, and the samples in which no residual doping agents were existing in spongy form rates as A.

Table 1

| Sample No. | Washing Fluid Concentration (%) | | Residual Doping Agents (ppm) Al | Si | K | Impurities (ppm) Fe | Ni | SEM Rating | Remarks |
|---|---|---|---|---|---|---|---|---|---|
| 1 | HCl | 1 | 60 | 2300 | 120 | 40 | 25 | C | Control |
| 2 | " | 2 | 50 | 2100 | 117 | 35 | 23 | C | " |
| 3 | " | 3 | 45 | 2000 | 100 | 25 | 20 | C | " |
| 4 | " | 4 | 37 | 1800 | 93 | 19 | 11 | C | " |
| 5 | " | 5 | 39 | 1790 | 90 | 20 | 13 | C | " |
| 6 | " | 10 | 38 | 1850 | 91 | 18 | 12 | C | " |
| 7 | HF | 1 | 36 | 1380 | 99 | 42 | 29 | C | " |
| 8 | " | 2 | 30 | 900 | 95 | 39 | 28 | C | " |
| 9 | " | 3 | 19 | 300 | 85 | 26 | 27 | B | " |
| 10 | " | 4 | 18 | 295 | 82 | 25 | 27 | B | " |
| 11 | " | 5 | 22 | 285 | 85 | 24 | 26 | A | " |
| 12 | " | 6 | 20 | 290 | 87 | 25 | 25 | A | " |
| 13 | " | 10 | 20 | 298 | 83 | 23 | 26 | A | " |
| 14 | HCl<br>HF | 3<br>4 | 18 | 290 | 84 | 24 | 20 | B | " |
| 15 | HCl<br>HF | 4<br>3 | 20 | 292 | 85 | 19 | 10 | A | This invention |
| 16 | HCl<br>HF | 4<br>5 | 19 | 289 | 86 | 19 | 11 | A | " |
| 17 | HCl<br>HF | 3<br>5 | 20 | 290 | 88 | 22 | 19 | B | Control |
| 18 | HCl<br>HF | 3<br>10 | 18 | 291 | 87 | 21 | 21 | B | " |
| 19 | HCl<br>HF | 4<br>1 | 30 | 1030 | 90 | 19 | 10 | C | " |
| 20 | HCl<br>HF | 7<br>1 | 26 | 870 | 93 | 20 | 9 | B | " |
| 21 | HCl<br>HF | 7<br>3 | 17 | 293 | 85 | 18 | 9 | A | This invention |
| 22 | HCl<br>HF | 7<br>6 | 16 | 190 | 78 | 17 | 9 | A | " |

(Note:
In this table, HCl and HF stand for hydrochloric acid and hydrofluoric acid, respectively.)

Next, several samples of tungsten powder shown in Table 1 (Samples 10, 11, 14, 15 and 21) were pressed, sintered, swagged, and drawn by conventional techniques to obtain tungsten wires having a diameter of 0.39 mm. In order to examine their high temperature deformation, five specimens were taken from each of the wires thus obtained, and compared according to JIS (Japanese Industrial Standards) H4460-1970 entitled "Thermal Deformation Test". The results are given in Table 2 below.

Table 2

| Sample No. | Specimen No. | Measured Value (mm) |
|---|---|---|
| 10 | 1 | 11.5 |
| | 2 | 13.0 |
| | 3 | 10.0 |
| | 4 | 12.5 |
| | 5 | 10.0 |
| 11 | 1 | 10.0 |
| | 2 | 9.5 |
| | 3 | 9.5 |
| | 4 | 10.5 |
| | 5 | 9.0 |
| 14 | 1 | 9.5 |
| | 2 | 11.0 |
| | 3 | 10.5 |
| | 4 | 9.0 |
| | 5 | 11.0 |
| 15 | 1 | 9.5 |
| | 2 | 8.5 |
| | 3 | 9.0 |
| | 4 | 8.0 |
| | 5 | 8.5 |
| 21 | 1 | 8.5 |
| | 2 | 9.0 |
| | 3 | 8.0 |
| | 4 | 9.0 |

Table 2-continued

| Sample No. | Specimen No. | Measured Value (mm) |
|---|---|---|
| | 5 | 8.5 |

As is evident from Table 1, the samples washed with HCl alone (Samples 1 through 6) contained a large amount of residual doping agent and a considerably large amount of silicon (Si) in particular, resulting in unsatisfactory washing. But, so far as its concentration was 4% or higher, HCl seemed to be effective in removing impurities. Upon observation with SEM, the samples washed with HCl alone, regardless of its concentration, were undesirably rated as C.

The samples washed with HF alone (Samples 7 through 13) seemed to be satisfactorily freed of unnecessary doping agents when HF had a concentration of 3% or higher. But, regardless of its concentration, impurities were not sufficiently removed by washing with HF alone. Upon observation with SEM, the samples washed with HF having a concentration of 5% or higher were rated as A in spite of the presence of impurities, presenting such a desirable condition that the residual doping agents were distributed uniformly.

For Samples 15, 16, 21, and 22 which were prepared in accordance with this invention, good results were obtained upon both chemical analysis and observation with SEM. Though some other samples (Samples 14 and 17 through 20) were also washed successively with HCl and HF or with a mixture thereof, the washing effect was insufficient because the concentration of either HCl or HF was below the specified lower limit. Some of the unsatisfactorily washed samples were properly selected and again washed under the same conditions, except that the washing time was doubled. As a result, the washing effect showed a slight improvement, but failed to present a striking contrast.

As can be seen from Table 2, the specimens made of Samples 15 and 21 (prepared in accordance with this invention) underwent only a very low degree of high temperature deformation and showed little variation in the amount of deformation among the specimens. On the other hand, the specimens made of Samples 10, 11, and 14 (controls) underwent a high degree of high temperature deformation and showed great variation in the amount of deformation.

Although a tungsten material suitable for use as filaments for common electric tubes and bulbs was exclusively discussed in the above example, it has been confirmed that similar results can also be obtained with respect to tungsten materials doped with $K_2O$ and $SiO_2$ and thus suited for use as heaters for vacuum deposition as well as tungsten materials doped with, in addition to $Al_2O_3$, $K_2O$, and $SiO_2$, a proper combination of Co, Fe, and Sn for the purpose of improving their workability.

What we claim is:

1. In a method for preparing a tungsten material comprising the steps of reducing tungsten oxides having doping agents added thereto, washing the resulting tungsten powder with an acid, and thereafter drying the washed tungsten powder, the improvement comprising conducting said washing step separately with hydrochloric acid and then with hydrofluoric acid by first washing said tungsten powder with hydrochloric acid having a concentration of not less than 4% by weight and thereafter washing with hydrofluoric acid having a concentration of not less than 3% by weight.

2. The method according to claim 1 in which said hydrochloric acid has a concentration of from 4 to 12% by weight and said hydrofluoric acid has a concentration of from 3 to 15% by weight.

3. The method according to claim 2 in which said hydrochloric acid concentration is from 4 to 7% by weight and said hydrofluoric acid concentration is from 3 to 6% by weight.

4. In a method for preparing a tungsten material including the steps of (a) reducing tungsten oxides having doping agents added thereto, (b) washing the resulting tungsten powder with an acid, and thereafter (c) drying the washed tungsten powder, the improvement consisting of conducting the washing step separately with hydrochloric acid and then with hydrofluoric acid by first washing with:

(1) hydrochloric acid having a concentration of from 4 to 12% by weight, and thereafter washing with (2) hydrofluoric acid having a concentration of from 3 to 15% by weight.

5. The method according to claim 4 in which said hydrochloric acid concentration is from 4 to 7% by weight and said hydrofluoric acid concentration is from 3 to 6% by weight.

* * * * *